US007927041B2

(12) United States Patent
Bonnemaire et al.

(10) Patent No.: US 7,927,041 B2
(45) **Date of Patent: *Apr. 19, 2011**

(54) DEEP WATER FLEXIBLE RISER PROTECTION

(75) Inventors: Basile Bonnemaire, Trondheim (NO); Ove Tobias Gudmestad, Nærbø (NO); Sveinung Løset, Trondheim (NO)

(73) Assignee: Statoil ASA, Stavanger (NO)

( * ) Notice: Subject to any disclaimer, the term of this patent is extended or adjusted under 35 U.S.C. 154(b) by 38 days.

This patent is subject to a terminal disclaimer.

(21) Appl. No.: 10/540,507

(22) PCT Filed: Nov. 11, 2003

(86) PCT No.: PCT/NO03/00378

§ 371 (c)(1),
(2), (4) Date: Jun. 23, 2005

(87) PCT Pub. No.: WO2004/059119

PCT Pub. Date: Jul. 15, 2004

(65) Prior Publication Data

US 2006/0177273 A1 Aug. 10, 2006

(30) Foreign Application Priority Data

Dec. 27, 2002 (NO) ..... 20026270

(51) Int. Cl.
*E21B 17/01* (2006.01)

(52) U.S. Cl. ..... 405/216; 405/211

(58) Field of Classification Search ..... 114/243; 405/211, 211.1, 212–217; 166/359, 367
See application file for complete search history.

(56) References Cited

U.S. PATENT DOCUMENTS

| | | | | | |
|---|---|---|---|---|---|
| 2,419,053 | A | * | 4/1947 | Bennett | 174/15.6 |
| 2,859,836 | A | * | 11/1958 | Wiener | 188/378 |
| 3,370,432 | A | | 2/1968 | Butler et al. | |
| 3,813,477 | A | * | 5/1974 | Fischer | 174/70 R |
| 4,031,919 | A | * | 6/1977 | Ortloff et al. | 137/799 |
| 4,063,428 | A | | 12/1977 | Waas | |
| 4,436,451 | A | | 3/1984 | Anderson | |
| 4,505,618 | A | | 3/1985 | Yashima | |
| 4,782,781 | A | * | 11/1988 | Poldervaart | 403/33 |
| 4,844,213 | A | * | 7/1989 | Travis | 188/377 |
| 5,169,265 | A | * | 12/1992 | Butler et al. | 405/224.4 |
| 5,931,602 | A | | 8/1999 | Gulbrandsen et al. | |
| 7,114,885 | B2 | * | 10/2006 | Loset et al. | 405/224.2 |

FOREIGN PATENT DOCUMENTS

| | | | |
|---|---|---|---|
| GB | 2377237 A | | 1/2003 |
| JP | 53-139198 | | 12/1978 |
| WO | WO01/53651 | * | 7/2001 |
| WO | WO 2004028895 A1 | * | 4/2004 |

* cited by examiner

*Primary Examiner* — Sunil Singh
(74) *Attorney, Agent, or Firm* — Foley & Lardner LLP

(57) ABSTRACT

Flexible riser systems are used to transfer hydrocarbons between a sea bed installation and a vessel floating at the sea surface. The riser is provided with a protection mechanism to protect the riser from impacts. The protection mechanism covers at least the upper part of the riser and may be retractable to an in-active position. When in operation, the riser protection mechanism is either suspended from the vessel or from a submerged turret buoy, forming part of a mooring system for the vessel. At its lower end, the protection mechanism is provided with an annular body surrounding the riser, the annular body having sufficient weight to provide a downwardly acting force in the riser protection mechanism, causing a stretch or a tension in the riser protection mechanism.

31 Claims, 5 Drawing Sheets

DEEP WATER FLEXIBLE RISER PROTECTION

This application is a National Stage application of PCT/NO2003/000378, filed Nov. 11, 2003, which claims priority from Norwegian patent application NO 20026270, filed Dec. 27, 2002. The entire contents of each of the aforementioned applications are incorporated herein by reference.

The present invention relates to flexible riser systems designed to operate in deeper ice infested waters where it may be necessary to protect parts of but not the entire length of the flexible riser. More particularly, the present invention relates to protection of flexible risers for transfer of hydrocarbons from an installation on the sea bed to a floating vessel in an area exposed to drifting ice. Such a riser may for example, be required for STL loading or transfer of hydrocarbons to or from a floating production platform or vessel in deeper ice infested waters. The invention could also be used in areas where other types of drifting obstacles are present, e.g. drifting nets or drifting timber.

BACKGROUND OF THE INVENTION

Oil exploration has moved into deeper arctic waters. Motion of drifting ice is often a crucial problem when designing and planning a production system or an off-take loading and mooring system in ice infested waters. It is imperative to design systems and methods which eliminate the risks for pollution, caused by damage to the equipment due to impact from the drifting ice.

The drifting motion of ice is mainly governed by wind, waves, ocean currents and tidal forces. From analyses for the Eastern Barents Sea, it has been found that on a large time scale the ice drifting motion is clearly stochastic and with the exception of periods with rather straight lined movements, it resembles Brownian motion. Since ice floes are generally large and heavy, the direction and absolute value of their speed cannot change momentarily. Models predict steady motion of the ice, but occasionally the direction of ice drift may change to the opposite direction in roughly half an hour. This is a major concern for a conventional loading concept where the tanker, say 90 000 DWT, is staying in the "wake" behind a platform or a tower extending up above the sea level. If using a submerged loading concept instead in waters subjected to drifting ice, allowing the tanker to "ice-vane", advantages may be achieved.

Tests executed in 1997 and 2000 at the Hamburg Ship Model Basin (HSVA), Germany, testing the Submerged Turret Loading system, STL, in frozen seas, showed that underkeel installations may be in contact with ice as soon as the ice conditions worsens (interactions with ice ridges). Hence, the riser has to be protected from this hazard.

PRIOR ART

U.S. Pat. No. 5,820,429 describes an arrangement of a loading/unloading buoy for use in shallow waters wherein a buoy is arranged for introduction and releasable securement in a downwardly open receiving space in a floating vessel. The buoy comprises a bottom anchored centre member for the passage of fluid from or to a transfer line which is coupled to the underside of the center member. The buoy further comprises an outer member which is rotatably mounted on the center member to allow turning of the vessel about the center member when the outer member is secured in the receiving space. The buoy is provided with a bottom support structure which is connected to the center member of the buoy and arranged for support of the buoy at the sea bed when not in use. To the center member of the buoy there are connected a number of mooring lines extending outwards from the buoy a substantial distance along the sea bed. Such a system has an inherent elasticity allowing raising of the buoy from the sea.

SUMMARY OF THE INVENTION

The object of the invention is to achieve protection for flexible risers employed in ice infested waters, protecting at least the upper part of a riser extending between the sea bed and a floating platform or vessel.

A further object of the present invention is to provide riser and a riser protection means which quickly may be retracted to a submerged, in-operative position, permitting the riser to be quickly disconnected from its connection point on the vessel or platform and possibly retracted to a position on depths where the riser will not be exposed to impact by the drifting ice. Correspondingly, it is an object to achieve a loading system where the loading operation may be quickly aborted and the moored tanker may be quickly released from the mooring and riser system. It is envisaged that the system may also be used for transfer of hydrocarbons to or from a floating platform and equipment mounted on the sea bed.

Furthermore, according to the invention, means for maintaining a downwards stretch and/or tension in the riser protection means is provided, thereby ensuring proper protection of the flexible riser when exposed to impact from ice floes, debris or the like.

In order to ensure the integrity of the riser during operation, and in order to ensure that the riser protection system will protect the riser properly, a special stretching or tensioning device is incorporated into the riser design. According to a preferred embodiment this device could be made in the form of an annular body attached to the lower end of the riser protection system and extending around the flexible riser, suspended from the lower end of the riser protection means, thereby ensuring that the riser protection device is stretched out and tensioned.

The stretching or tensioning device will also act as a damping means on the motion of the riser, if and when the protection means is hit by an ice floe. The stretching and tensioning device will thus have two functions: it will provide the required protection for the flexible riser by ensuring that the protection means is stretched out and it will also function as a damper, limiting the motion of the flexible riser, including the protection means, should the riser protection interact with an ice floe.

It should furthermore be envisaged that the riser may be considerably exposed to wear and tear in the region where it passes the stretching or tensioning device and that it will advantageous if the riser is protected by a rubber collar or similar means.

According to the present invention the objects are achieved by means of a riser protection system as further defined in the claims.

BRIEF DESCRIPTION OF THE DRAWINGS

The invention will be further described in detail below in connection with an exemplary embodiment with reference to the drawings, wherein.

DETAILED DESCRIPTION OF THE PREFERRED EMBODIMENT

Reference is made to the Applicant's co-pending NO Patent Applications Nos. 2002.4584 and 2002.4585, relating to flexible risers designed to operate in ice infested waters. The content of these two publications are hereby included by reference. The two identified applications relate in particular to risers for shallow waters, possibly incorporating a silo at the sea bed in which the riser is stored when not in use. The complete length of the riser is being protected by means of a protection element in the form of buckets, ensuring the flexibility of the riser. The buckets are stacked on top of each other when the riser is being disconnected and lowered to the sea bed.

Figure 1:
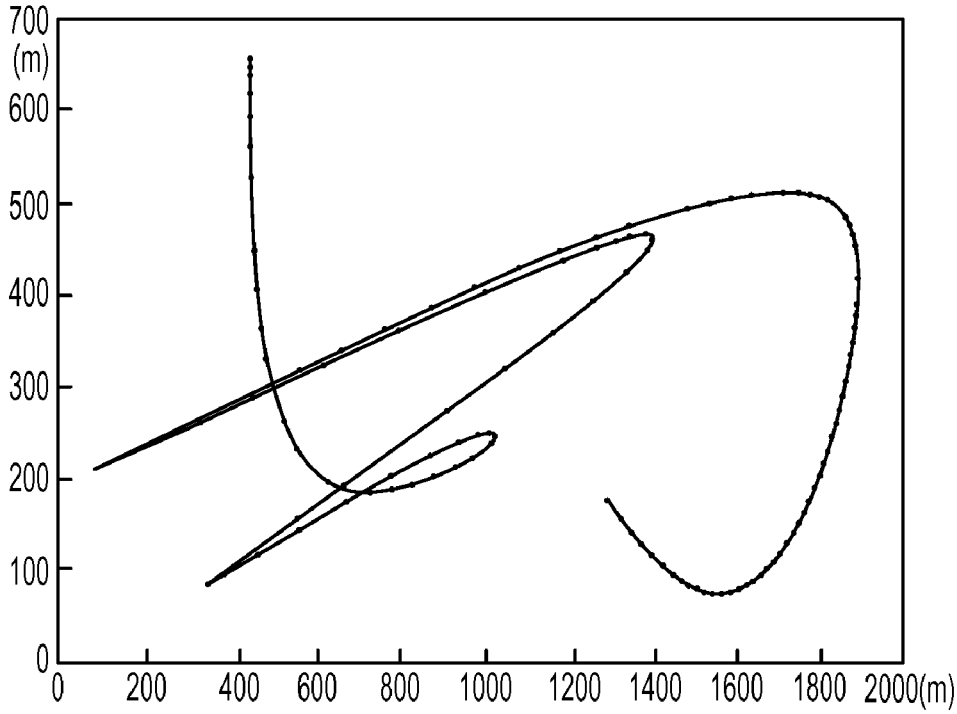
FIG. 1 shows modelled movement of the ice drift, distances in m.

FIG. 1 shows modelled movements of the ice drift. The increment between each dot on the graph represents a time lapse of 10 minutes. The Figure gives an impression of the movement during a 24-hour period. As indicated on the graph, the model predicts steady motion of the ice. Occasionally, however, the ice drift may change to the opposite direction in roughly half an hour.

Figure 2:
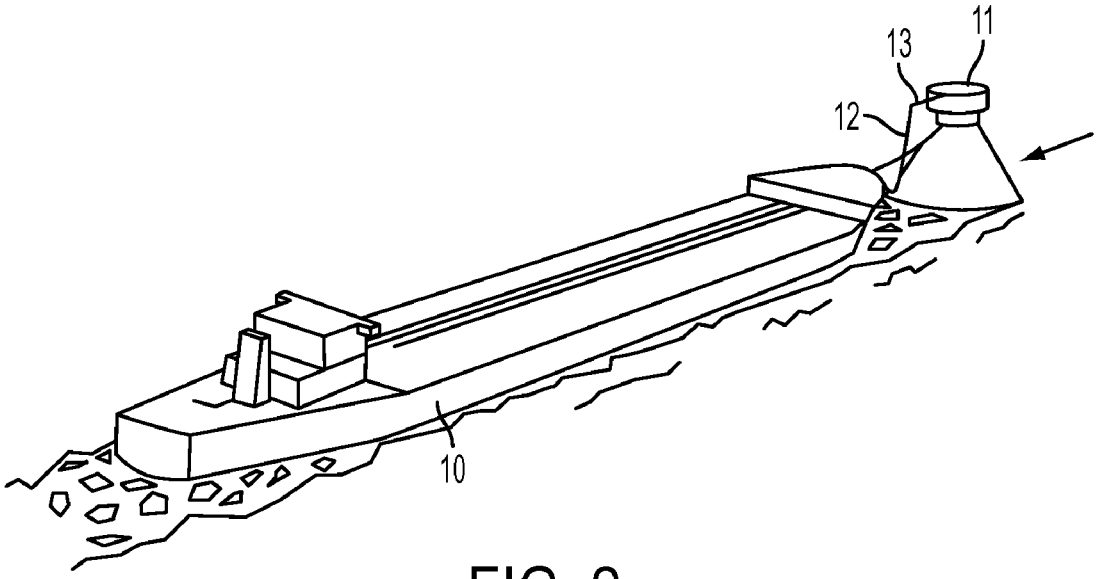
FIG. 2 shows a typical prior art loading system.

In FIG. 2 a tanker vessel or a Floating Production Vessel (FPSO) 10 is moored to a fixed platform 11 and fluids are transferred from the platform 11 to the vessel 10 through a flexible hose 12. The flexible hose 12 is suspended from a rotatably arranged loading arm 13. Since the vessel is only moored to the platform, the possibility of collision between the vessel 10 and the platform 11 is large if and when the drifting direction of the ice changes abruptly. In such a case, the loading operation must stop immediately and the tanker 10 must quickly be released from its mooring system.

In order to overcome such problems, a sub sea loading concept is required, reducing the possible interference with the drifting ice, and still allowing the tanker 10 to 'ice-vane' depending on the movement of the drift ice.

Figure 3:
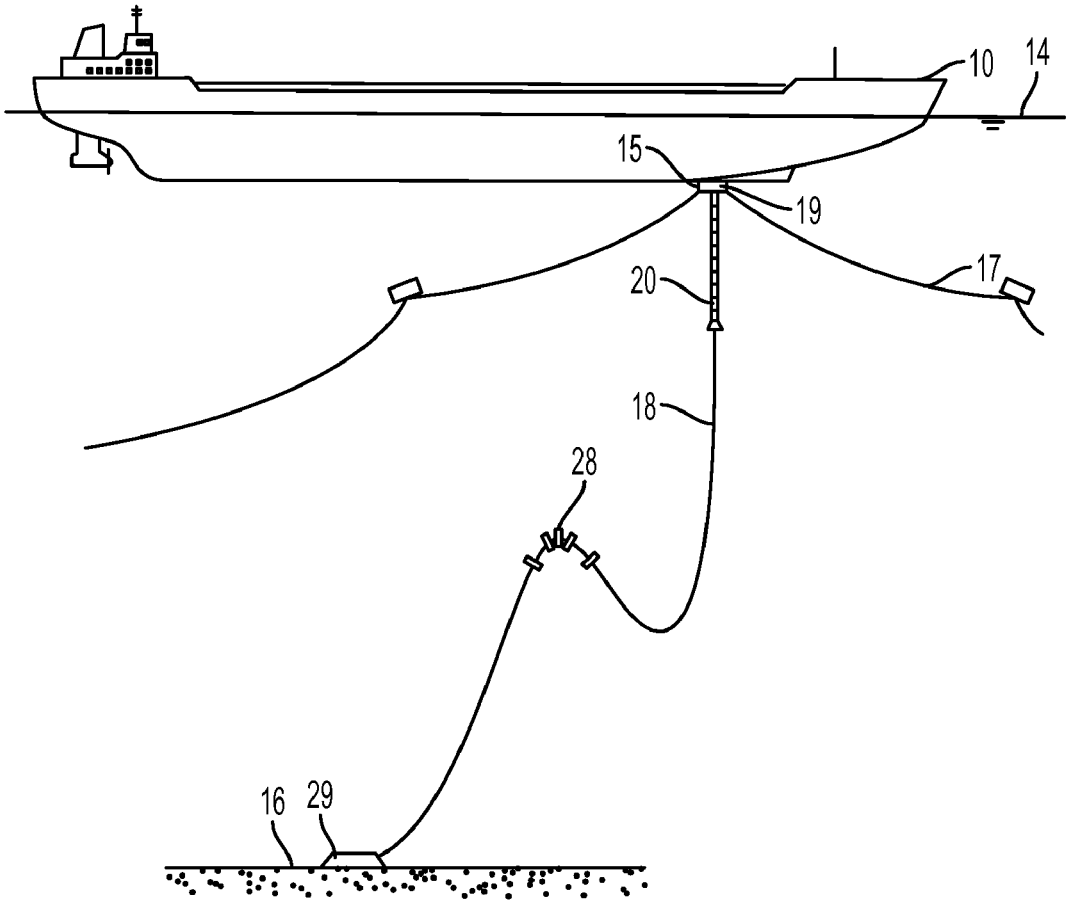
FIG. 3 shows the loading system according to the invention wherein the riser and a STL buoy are connected to a vessel.

FIG. 3 shows in principle a preferred embodiment of a loading system according to the invention. As shown in FIG. 3, a vessel 10 (or a floating platform) is floating on the sea surface 14. The vessel 10 is equipped with a moon pool 15, and is rotatably moored to the sea bed 16 by means of a plurality of mooring lines 17. A flexible riser 18 extends between the sea bed 16 and the vessel 10. The flexible riser shown in FIG. 3 is given a sag bend and a hog bend by means of buoys 28, in order to compensate for vertical movement imposed by the vessel. At its upper end the riser 18 is connected to a submerged turret buoy 19. At its lower end the riser 18 is connected to a wellhead or manifold 29 on the sea bed 16. The mooring lines 17 are coupled to the submerged turret buoy 19, allowing the vessel to weathervane. Such turret buoy 19 may be of a type as is further detailed in the applicants U.S. Pat. No. 5,820,429, the content of which hereby is included by reference. The upper end of the riser 18 is releasable connected to a corresponding pipe line onboard the vessel by means of a swivel joint (not shown).

According to the invention, the riser 18 is protected by a riser protection means 20. According to the embodiment shown in FIGS. 3, 4 and 5 the upper end of the riser protection means 20 is suspended from the submerged turret buoy 19 by means of a plurality of chains, wires or the like 21. The lower end of the riser protection means 20 is coupled to a stretching or tensioning device 22, having sufficient weight to provide the required-downwards stretch or tension in the riser protection device 20. The stretching device may be formed by an annular body surrounding the flexible riser 18.

Figure 4A:
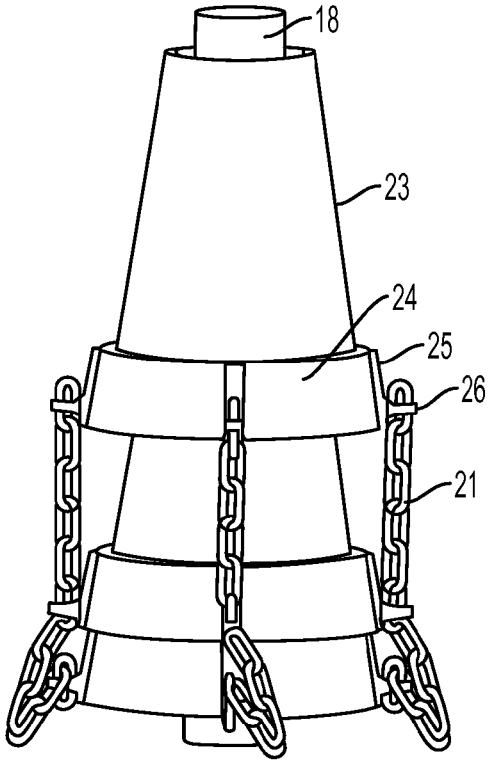
FIG. 4*a-c* shows details of the riser protection means.
Figure 4B:
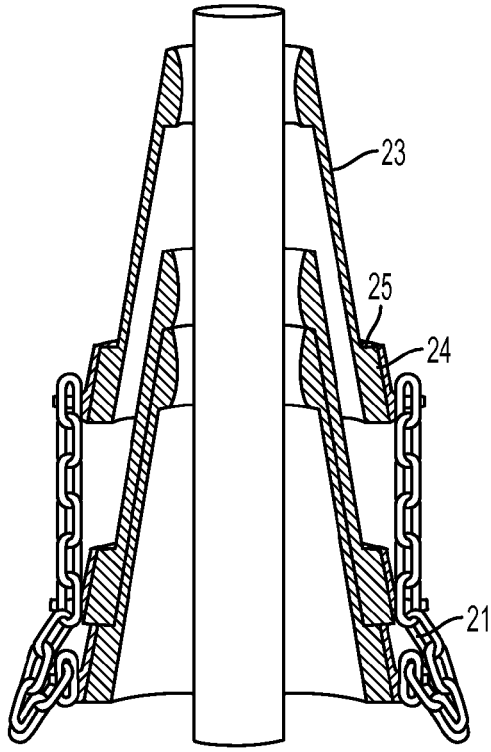
Figure 4C:
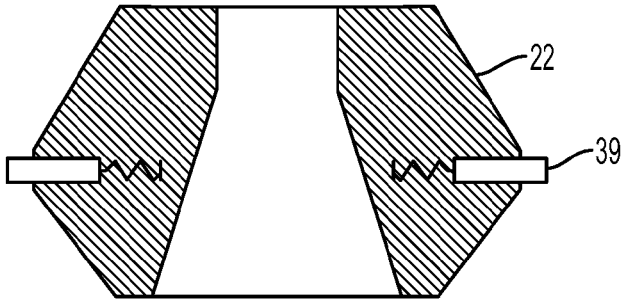

According to a preferred embodiment of the invention the riser protection means 20 comprises a plurality of hollow, truncated conical elements 23, having a smaller upper diameter and a larger lower diameter or vice versa, ref. FIG. 4.

FIG. 4 shows main parts of the riser protection means 20. Thus, the figure the protection means comprises a plurality of hollow, upwards truncated, conical elements 23. Each element is open-ended at both ends. The elements 23 are suspended from each other by means of chains or wires 21. The riser extends through the set of elements 23.

Such riser protection means 20 will resist dragging and impact loads from ice passing under the keel of the vessel. The design of the elements 23 in the riser protection means 20, (ref. FIGS. 3 and 4) will provide the required bending capabilities due to the suspended, separate elements, suspended by wires or chain 21 and will protect the riser from excessive bending.

Since the elements 23 are suspended to each other, the elements 23, when the riser protection means 20 is retracted into an inactive position, will be stacked into each other. This allows the riser protection means 20 always to have an adequate length.

If the elements 23 are suspended independently of the riser 18 from the vessel or from the STL buoy 19, the riser 18 will heave with the vessel 10 and will to a certain degree slide within the lower element 23.

A possible design for the elements 23 is presented in FIG. 4. This design may be varied without deviating from the inventive idea and is only shown to give an idea of the function of the elements 23. On the drawing, chains 21 are used to link the elements 23. It should be appreciated however, that wires or other type of links may be used. The drawing suggests further that four chains 21 are used to link the elements 23. It should be appreciated that the number of chains may be varied, as for example three chains may be suitable.

As further shown on FIG. 4 the wider rim 24 of each element 23 may be provided with a stacking ridge 25 which also includes attachment eyes 26 for the chains 21.

FIG. 4 shows further a schematic view of one embodiment of the riser stretching element 22.

Figure 5:
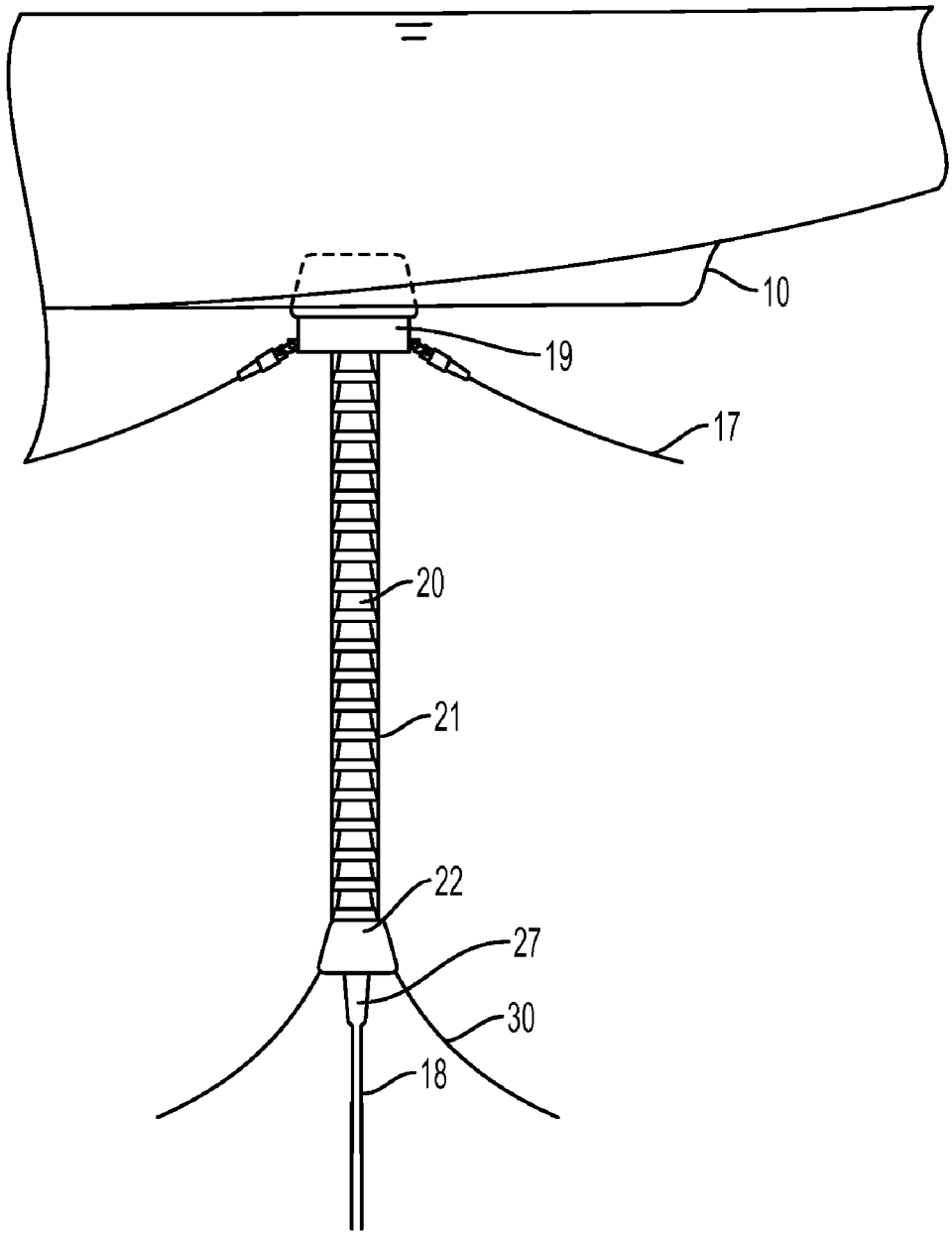
FIG. 5 shows in more detail the loading system and the riser protection means according to the present invention.

FIG. 5 shows in more detail the riser protection system shown in FIG. 3. As shown, the riser 18 is suspended from a STL buoy 19 arranged in the turret on a vessel 10 floating at the sea surface. Further, the riser protection means 20 is suspended from the STL buoy 19 by means of chains 21. The riser 18 is further in the region of the lower end of the riser protection means 20 provided with a rubber collar 27 or similar means. The purpose of the rubber collar 27 is inter alia other to protect the riser 18 from wear and tear caused by the annular body 22 due to motions caused by waves, sea current, drifting ice and debris or wind. The collar 27 may have any suitable shape or dimensions and may be formed of any suitable material providing wear and tear resistance on the riser 18. The collar 27 provides also a controlled distribution of forces caused by the annular body 22 onto the riser 18.

Figure 6:
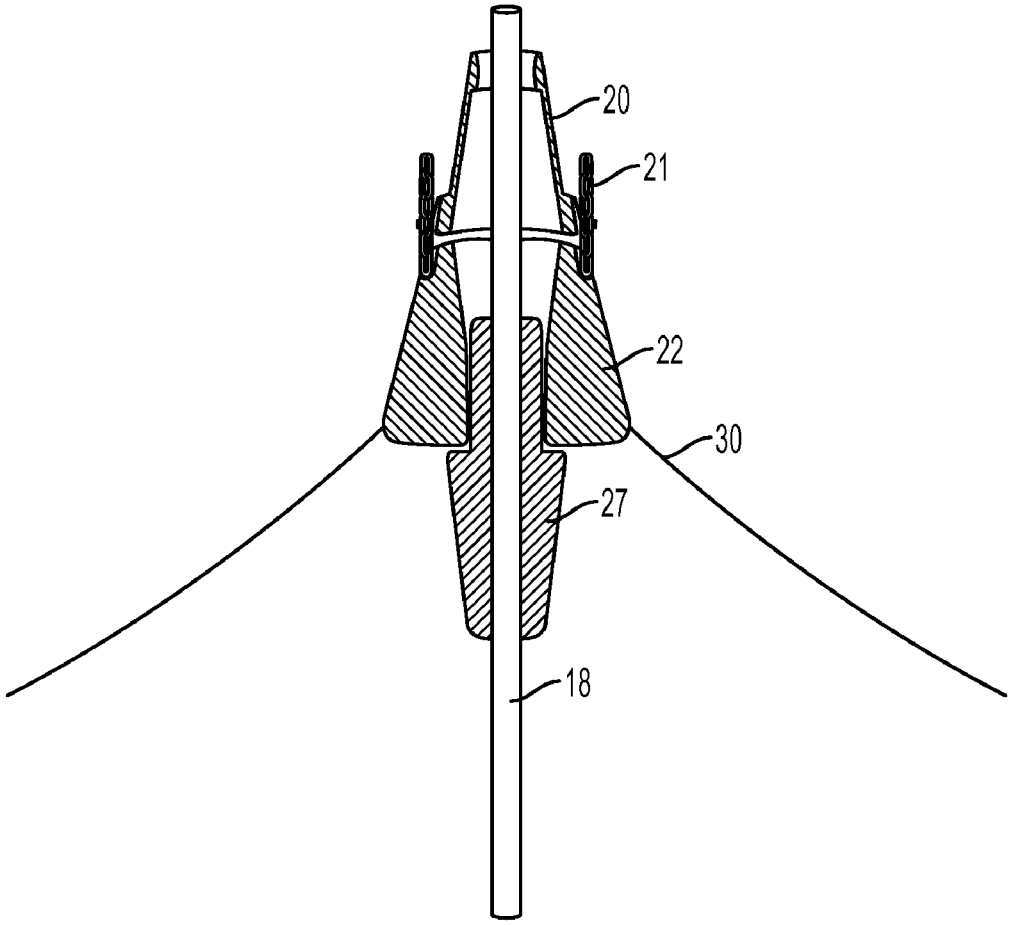
FIG. 6 shows an enlarged vertical section through an embodiment of the stretching and tensioning device according to the invention.

FIG. 6 shows a vertical section through one embodiment of the invention, showing the annular body 22, suspended by chains from the riser protection means 20 (not shown). As shown, the lower internal corner of the annular body 22 is wedged, while a collar 27 is arranged around the riser 18. The purpose of this embodiment is to minimize the possibility of damaging the riser caused by relative moment between the riser 18 and the tensioning device 22.

The annular body 22 may according to one embodiment of the invention be provided with anchor chains or wires 30, increasing the downwardly acting force on the riser protection means 20, thereby improving tension or the stretch in the riser protection means 20.

The riser protection means 20 may, for example, be suspended from the STL buoy 19 also when in an inactive position, detached from the vessel. Alternatively, the riser protection means 20 may be temporarily stored in a stacked position on board the vessel 10, either in conjunction with a turret/moon pool or in conjunction with an arrangement in the bow region of the vessel in case such type of single point mooring systems are used.

For deeper waters, the riser protection means 20 does not need to cover the riser 18 along its entire length, but only the upper part which may be subjected to ice loads. Limiting the riser protection means 20 to cover only the upper part of the riser 18 will allow the system still to be compact when stored on the sea bed 16.

An important advantage of this system is its ability to operate in any ice condition. As long as the vessel 10 and the mooring 17 can withstand the incoming sea ice, so will the riser 18, as partly protected under the vessel 10. The vertical elasticity of the system makes it able to cope with quite heavy seas. This loading system will thus have a very high operability rate.

This transfer system is independent of the methods used for connection to the vessel 10. It is very suitable for the STL system for example, but may also be employed in other systems. It could for example be adapted to be used as a Single Anchor Mooring loading system for light ice infested waters or waters with for example drifting nets or drifting timber.

The loading system according to the invention may be installed in different water depths, preferably for depths exceeding 20 m.

The system described above, incorporating the stretching or tensioning device, could be applied in connection with all types of floating units. It is particularly attractive as an integral part of an STL loading system in deeper water with ice, but it could also be applied as an integral part of any offshore loading system. Furthermore, the system could be applied in connection with a floating production or drilling platform where some means of riser protection would be needed for some or all of the platform risers. It should be noted that the system in principle could also provide protection of the risers against any type of impacts in addition to impacts from ice floes. Such cases could be impact from steep or breaking waves, floating debris (like timber), some protection in case of impact from ships will also be provided.

The invention claimed is:

1. A flexible riser system for a loading system for transferring hydrocarbons between a sea bed installation and a vessel floating at a sea surface, comprising:

a flexible riser; and protection means configured to protect the riser from impact when the riser is connected to the vessel, the protection means being submerged below the vessel and covering at least an upper part of the riser and terminating above the sea bed when the riser is submerged and connected to the vessel, the protection means being formed of a plurality of separate units suspended from each other such that they are movable with respect to each other in a lateral and axial direction, the separate units arranged to be movable in transverse direction with respect to the riser, the protection means further being provided with a stretching means or a tensioning means attached to a lower end of the protection means, wherein the riser in the vicinity of the stretching or tensioning means is provided with a collar designed to reduce detrimental impact of the stretching or tensioning means on the riser caused by relative movement of the stretching or tensioning means with respect to the riser.

2. A flexible riser system for a loading system according to claim 1, wherein the protection means is temporarily suspended from the vessel.

3. A flexible riser system for a loading system according to claim 1, wherein the protection means is suspended from a submerged turret loading buoy.

4. A flexible riser system for a loading system according to claim 1, wherein the stretching or tensioning means is formed by an annular body surrounding the flexible riser.

5. A flexible riser system for a loading system according to claim 1, wherein the stretching or tensioning means is moored to the sea bed by means of wires.

6. A flexible riser system for a loading system according to claim 1, wherein the stretching or tensioning means at the lower end of its interior surface is provided with a curved surface opposing an outer surface of the collar designed to reduce detrimental impact or wear and tear on the riser caused by relative movement of the stretching means.

7. A flexible riser system for a loading system according to claim 1, wherein the stretching or tensioning means are suspended by means of chains or wires carrying the protection means.

8. A flexible riser system for a loading system according to claim 1, wherein the plurality of separate units comprise a plurality of separate hollow elements, each being suspended by means of chains or lines.

9. A flexible riser system for a loading system according to claim 8, wherein the hollow elements are truncated and conical with a smaller upper diameter and a larger lower diameter or vice versa.

10. A flexible riser system for a loading system according to claim 9, wherein the hollow elements forming the protection means are stacked on top of each other when in a retracted position.

11. A flexible riser system for a loading system according to claim 8, wherein the hollow elements forming the protection means are stacked on top of each other when in a retracted position.

12. A flexible riser system for a loading system according to claim 8, wherein the hollow elements are provided with an internally coating or friction reducing layer in order to minimize friction or load impact between the riser and the protection means, enabling the riser to move freely within the protection means.

13. A flexible riser system for a loading system according to claim 8, wherein each hollow element, at a wider edge of the hollow element, is provided with a stacking ridge enabling the hollow element to be stacked on a next element.

14. A flexible riser system for a loading system according to claim 1, wherein the protection means is completely retractable into a sheltered position on the vessel.

15. A loading system for transferring hydrocarbons between a sea bed installation and a vessel floating at a sea surface, comprising:

a vessel floating at a sea surface; and a flexible riser system comprising:

a flexible riser; and protection means connected to the vessel configured to protect the riser from impact, the protection means being submerged below the vessel and covering at least an upper part of the riser, and terminating above the sea bed, the protection means being formed of a plurality of separate units suspended from each other such that they are movable with respect to each other in a transverse and axial direction, the separate units arranged to be movable in transverse direction with respect to the riser, and a stretching means or a tensioning means arranged at a lower end of the protection means.

16. A loading system according to claim 15, wherein the protection means is temporarily suspended from the vessel.

17. A loading system according to claim 15, wherein the protection means is suspended from a submerged turret loading buoy.

18. A loading system according to claim 15, wherein the stretching or tensioning means is formed by an annular body surrounding the flexible riser.

19. A loading system according to claim 15, wherein the stretching or tensioning means is moored to the sea bed by means of wires.

20. A loading system according to claim 15, wherein the stretching or tensioning means at the lower end of its interior surface is provided with a curved surface designed to reduce detrimental impact or wear and tear on the riser caused by relative movement of the stretching means.

21. A loading system according to claim 15, wherein the riser in the vicinity of the stretching or tensioning means is provided with a collar designed to reduce detrimental impact on the riser caused by relative movement of the stretching or tension means with respect to the riser.

22. A loading system according to claim 15, wherein the stretching or tensioning means is suspended by means of chains or wires carrying the protection means.

23. A loading system according to claim 15, wherein the plurality of separate units comprise a plurality of separate hollow elements, each being suspended by means of chains or lines.

24. A loading system according to claim 23, wherein the hollow elements are truncated and conical with a smaller upper diameter and a larger lower diameter or vice versa.

25. A loading system according to claim 24, wherein the hollow elements forming the protection means are stacked on top of each other when in a retracted position.

26. A loading system according to claim 23, wherein the hollow elements forming the protection means are stacked on top of each other when in a retracted position.

27. A loading system according to claim 23, wherein the hollow elements are provided with an internally coating or friction reducing layer in order to minimize friction or load impact between the riser and the protection means, enabling the riser to move freely within the protection means.

28. A loading system according to claim 23, wherein each hollow element, at a wider edge of the hollow element, is provided with a stacking ridge enabling the hollow element to be stacked on a next element.

29. A loading system according to claim 15, wherein the protection means is completely retractable into a sheltered position on the vessel.

30. A method of operating a flexible riser system for a loading system for transferring hydrocarbons between a sea bed installation and a vessel floating at a sea surface, the flexible riser system having a flexible riser and a protection means formed of a plurality of separate units suspended from each other such that they are movable with respect to each other in a lateral and axial direction, the separate units arranged to be movable in transverse direction with respect to the riser, the protection means further being provided with a stretching means or a tensioning means attached to a lower end of the protection means, the method comprising:

transferring hydrocarbons between the sea bed installation and the vessel while the protection means is connected to the vessel and submerged below the vessel, such that the protection means covers at least an upper part of the riser and such that both the plurality of separate units and the stretching or tensioning means are disposed above the sea bed, the protection means arranged to protect the riser from impact.

31. The method of claim 30 further comprising:

retracting the protection means to a protected position below the sea surface together with the riser when the riser is not operating to transfer hydrocarbons between the sea bed installation and the vessel.

* * * * *